United States Patent [19]

Tsukabayashi et al.

[11] Patent Number: 5,016,451

[45] Date of Patent: May 21, 1991

[54] APPARATUS FOR TREATING CARBON FIBER FABRICS

[75] Inventors: Kazuo Tsukabayashi; Takashi Yamamoto; Yasunari Sawanoi, all of Ishikawa, Japan

[73] Assignees: Ishikawa Prefecture, Ishikawa; Nippon Oil Co., Ltd., Tokyo, both of Japan

[21] Appl. No.: 387,698

[22] Filed: Jul. 31, 1989

[30] Foreign Application Priority Data

Aug. 3, 1988 [JP] Japan ..... 63-193900
Oct. 24, 1988 [JP] Japan ..... 63-267641

[51] Int. Cl.[5] ..... D06B 13/00
[52] U.S. Cl. ..... 68/2; 68/3 SS
[58] Field of Search ..... 68/2, 3 SS; 118/57; 28/167, 168, 182, 183, 283; 26/18.5

[56] References Cited

U.S. PATENT DOCUMENTS 2,699,592 1/1955 Newnam ..... 68/3 SS X
2,800,682 7/1957 Dooley ..... 68/3 SS X
2,904,981 9/1959 Macomson ..... 68/3 SS
3,084,020 4/1963 Loosli ..... 68/3 SS X
3,688,527 9/1972 Blustain ..... 68/3 SS

FOREIGN PATENT DOCUMENTS 687970 2/1953 United Kingdom ..... 68/3 SS

*Primary Examiner*—Philip R. Coe
*Attorney, Agent, or Firm*—Scully, Scott, Murphy & Presser

[57] ABSTRACT

An apparatus for disintegrating a carbon fiber fabric. The apparatus includes a water vessel containing water, with an ultrasonic wave oscillator immersed in the water and a guide plate for the fabric being located in opposed relation to the oscillator. A conveyor is provided for continuously conveying the carbon fiber fabric along the side of the guide plate facing the oscillator. Sound waves generated by the oscillator function to press the carbon fiber fabric against the guide plate in a manner as to cause the fabric to be disintegrated under the effects of the ultrasonic waves.

4 Claims, 3 Drawing Sheets

APPARATUS FOR TREATING CARBON FIBER FABRICS

BACKGROUND OF THE INVENTION

The present invention relates to apparatus and method for treating carbon fiber fabrics and particularly to a disintegrating apparatus for a carbon fiber fabric obtained by using a multifilament yarn, namely, an apparatus for discretely separating carbon filaments bonded together with a sizing agent.

In molding a composite material which contains a woven texture of carbon fibers obtained by weaving a multifilament yarn, as a reinforcing member in a matrix resin, a step of disintegrating the filaments of the multifilament yarn as a step which precedes the molding step is known from Japanese Patent Laid Open No. 231073/1987. It is also disclosed therein to effect the disintegrating operation using ultrasonic wave. By the method using ultrasonic wave it is possible to greatly improve the strength of the composite material after molding, and the use of ultrasonic wave permits the individual filaments to be disintegrated in a more discrete state and also permits the effect of the method to be exhibited in a more satisfactory manner.

In order to practise the above method economically on an industrial scale it is necessary to use an apparatus for disintegrating the carbon fiber fabric continuously. This apparatus must be able to disintegrate the carbon fiber fabric efficiently and uniformly throughout the fabric into each constituent filament as completely as possible. Moreover, it is inevitably required that the cost of the apparatus itself and the running cost be low and that the operation as well as maintenance and control be easy.

It is the first object of the present invention to provide an apparatus particularly suitable for practising the disintegrating step using ultrasonic wave and capable of satisfying the above-mentioned requirements.

As to a sizing agent, if a fabric with a sizing agent adhered to the weaving yarn is impregnated with a matrix resin, the matrix resin is difficult to permeate the weaving yarn because a bundle of several hundred to several ten thousand filaments which constitute the weaving yarn is in a bonded state with the sizing agent. Therefore, it is desirable to remove the sizing agent from the fabric before the matrix impregnation.

As means for removing a sizing agent from a carbon fiber or glass fiber fabric there are known a heat setting method wherein the sizing agent is burnt off and a method wherein the sizing agent is removed using a solvent. In the heat setting method, however, there easily occur shift in weave and napping because the fabric is exposed to a high temperature, and if the sizing agent after decomposition and carbonization remains on the fiber surface, the reinforcing effect will be deteriorated markedly. The method using a solvent is also disadvantageous in that it usually requires the use of an expensive solvent so the cost is high and danger is involved therein and that the equipment required is large-sized.

Usually, therefore, a resin of the same sort as the matrix resin is used as the sizing agent to thereby omit the sizing agent removing step.

However, it is actually very troublesome to change the sizing agent according to the kind of the matrix resin used. Thermosetting resins typified by epoxy resins have heretofore been mainly used as the matrix of composite fiber-reinforced materials, but recently, in addition to epoxy and other thermosetting resins, various matrix resins have come to be used, including thermoplastic resins such as polyester, nylon and polyether ether ketone. Providing many kinds of sizing agents for such various matrix resins causes an increase of economic burden and gives rise to complicated problems in production management and inventory management. Such problems can be overcome if it is possible to inexpensively provide reinforcing yarn fabrics from which sizing agents have been removed. To this end it is necessary to find out a simple method for removing a sizing agent from a fiber-reinforced fabric.

It is the second object of the present invention to provide method and apparatus for removing a sizing agent from a reinforcing yarn fabric easily and efficiently.

SUMMARY OF THE INVENTION

The apparatus of the present invention disintegrates the constituent yarn of a carbon fiber fabric by the application of ultrasonic wave thereto in water. It also functions to remove an emulsion type sizing agent effectively from a carbon fiber fabric with the sizing agent adhered thereto by the application thereto of ultrasonic wave in water.

DETAILED DESCRIPTION OF THE INVENTION

Figure 1:
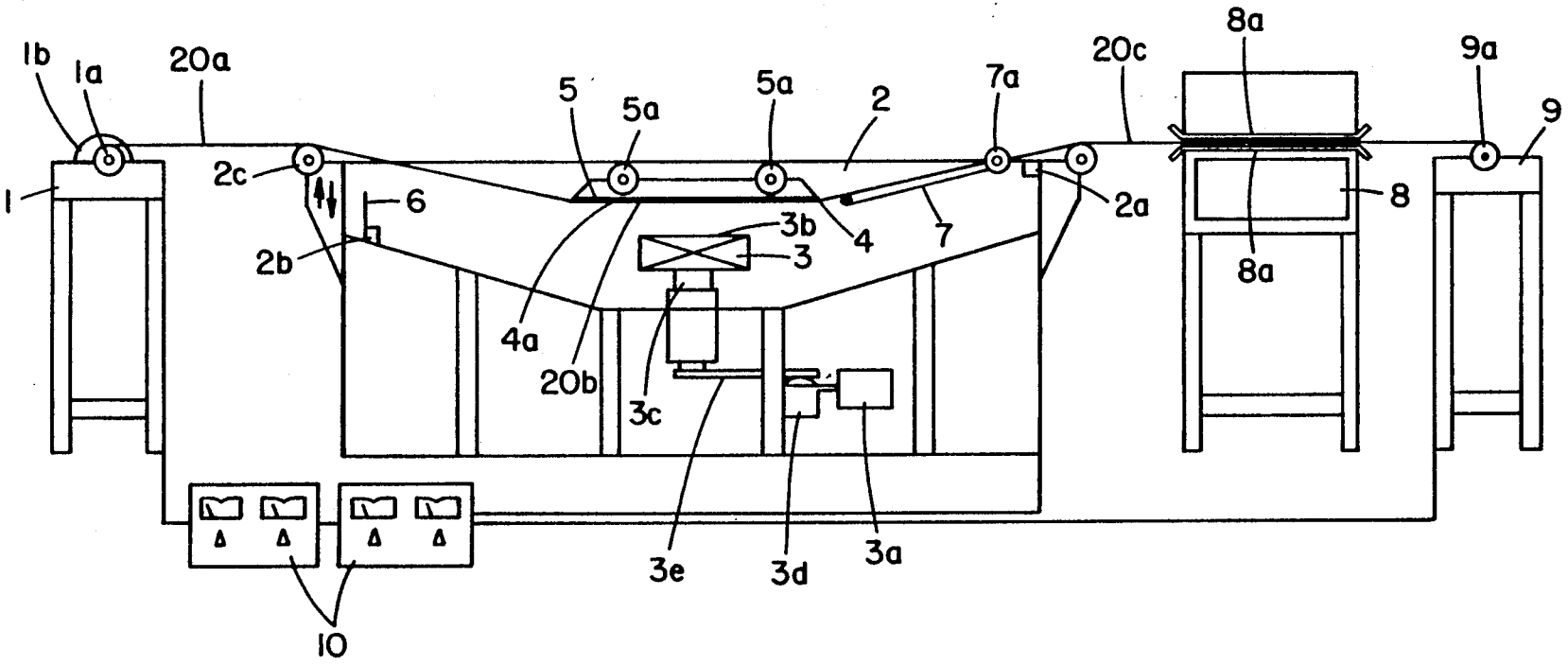
FIG. 1 is a side view schematically showing an example of the apparatus of the present invention.

The present invention will be described below with reference to the drawing.

The apparatus of the present invention includes a water vessel 2, an ultrasonic wave oscillator 3 immersed in the water vessel 2, a guide plate 4 opposed in water to the oscillator 3, and a conveyor means 7 for conveying a carbon fiber fabric 20 continuously along an oscillator-side face 4*a* of the guide plate 4.

The ultrasonic wave oscillator 3 is mounted rotatably about an axis which is perpendicular to the oscillator-side face 4*a* of the guide plate 4, and means 3*a* for rotating the oscillator about the said axis is provided, whereby it is made possible for the apparatus to effect a more uniform disintegration of yarn.

Figure 2:
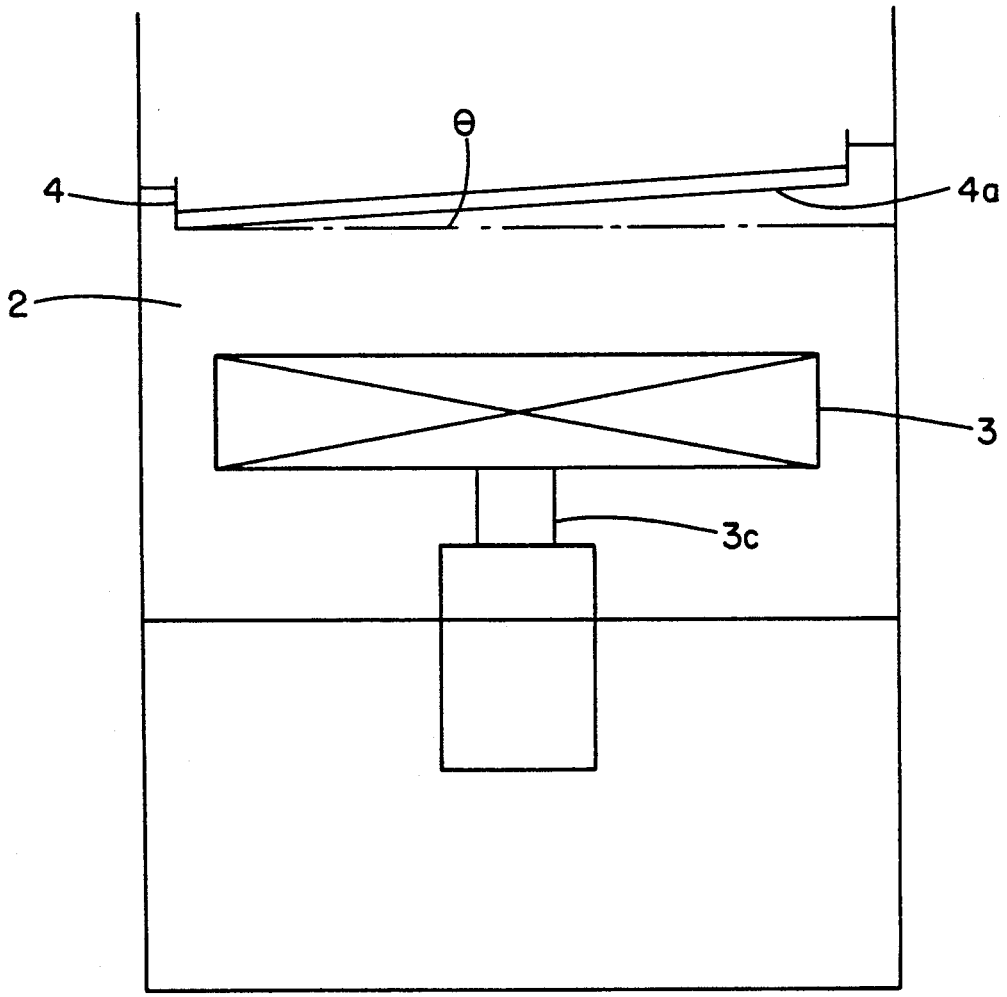
FIG. 2 illustrates a fragmentary portion of FIG. 1, on an enlarged scale, with the guide plate for the carbon fiber fabric being inclined relative to the water surface.
Figure 3:
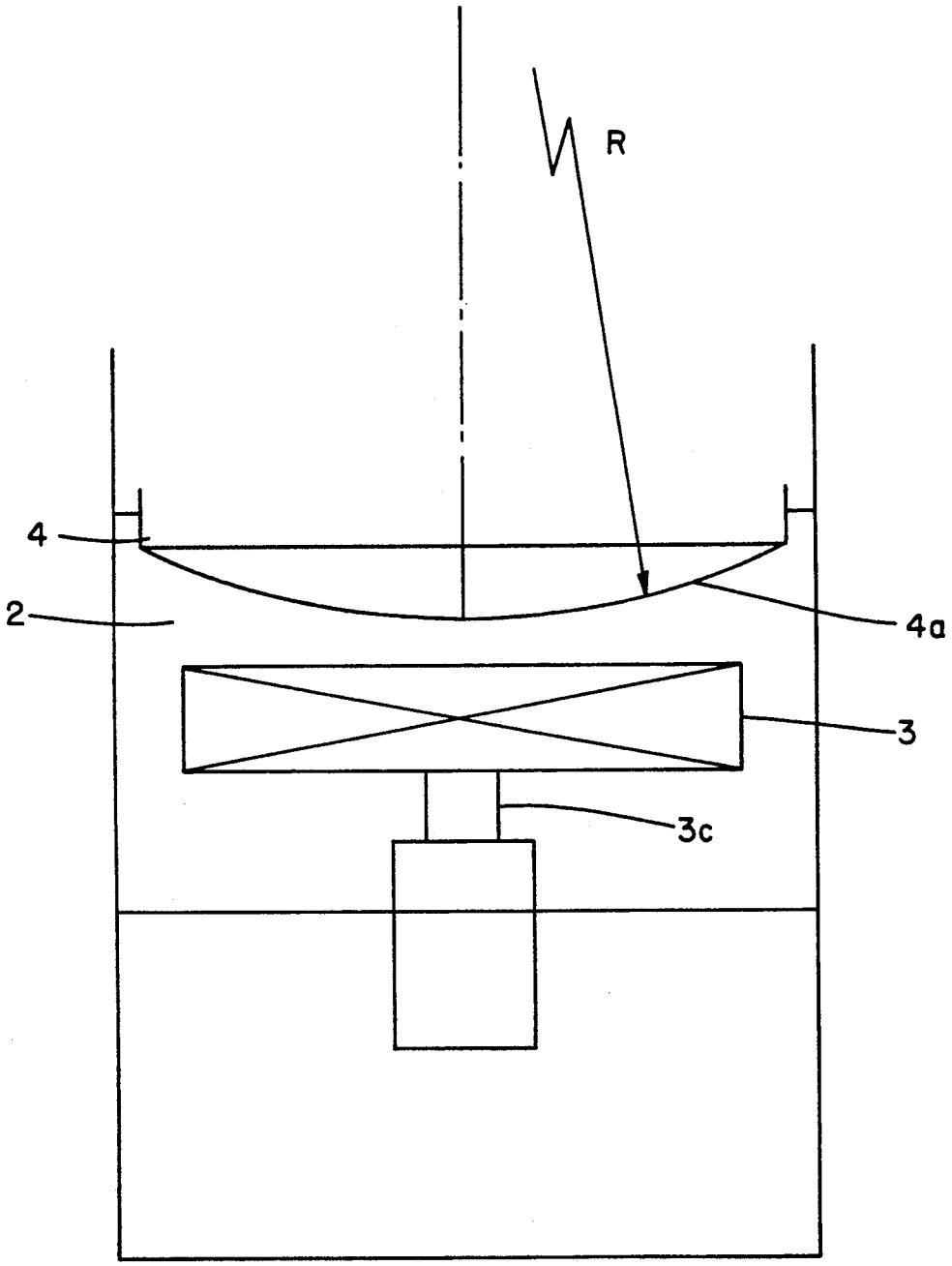
FIG. 3 illustrates the apparatus of FIG. 1, similarly to that shown in FIG. 2, with the guide plate for the carbon fiber fabric being convexly curved towards the oscillator side thereof.

Further, by inclining the oscillator 3-side face 4*a* of the guide plate 4 with respect to the water surface of the water vessel 2 as shown in FIG. 2, or by forming it as a curved surface which is convex on the oscillator side as shown in FIG. 3, it is made possible for the apparatus to effect the yarn disintegrating operation more efficiently and uniformly.

A carbon fiber fabric 20*a* to be disintegrated is conveyed by the conveyor means 7 and passes the ultrasonic wave oscillator 3 side of the guide plate 4. At this time, ultrasonic wave is applied to the thus-passing carbon fiber fabaric now indicated at 20*b*, so that the fabric 20*b* is brought into pressure contact with the guide plate 4 by virtue of the acoustic pressure and thereby spread out flatewise. In this state, the ultrasonic wave acts on the multifilament yarn which constituents the fabric, whereby the yarn is disintegrated. During this application of ultrasonic wave, the carbon fiber fabric 20*b* is held in a flatewise spread state in water and backed up by the guide plate 4, so the ultrasonic wave is applied to the fabric surface efficiently and uniformly. In the present invention the ultrasonic wave oscillator is employable in the frequency range of 20 to 50 KHz, preferably 26 to 28 KHz.

The thus yarn-integrated fabric, now indicated at 20*c*, is drawn out from the water vessel 2 continuously by the conveyor means 7 and wound up through a drying device 8 provided as necessary.

By using a carbon fiber fabric with an emulsion type sizing agent adhered thereto as the above carbon fiber fabric, the emulsion type sizing agent is removed effectively.

The "emulsion type sizing agent" as referred to herein indicates a sizing agent prepared by incorporating a surfactant into a water-insoluble sizing resin followed by dispersion in water. Examples of such water-insoluble sizing resin include known epoxy resins such as glycidyl ether type, e.g. bisphenol A diglycidyl ether, bisphenol F diglycidyl ether, phenol novolak polyglycidyl ether and cresol novolak polyglycidyl ether, glycidyl amine type, e.g. N,N-diglycidyl dianiline and N,N,N'N'-tetraglycidyl diaminodiphenylmethane, and mixtures thereof, as well as known polyamide resins and polyester resins.

As preferred examples of the surfactant are mentioned nonionic surfactants, particularly polyoxyethylene ethers. Concrete examples include polyoxyethylene octylphenyl ether, polyoxyethylene nonylphenyl ether, polyoxyethylene lauryl ether, polyoxyethylene cetyl ether, polyoxyethylene stearyl ether and polyoxyethylene oleyl ether.

In some particularly use there may be added an ester type lubricant such as, for example, oleyl oleate, stearyl oleate, lauryl oleate, oleyl stearate, oleyl laurate, or oleyl palmitate.

The carbon filament yarn comprising carbon filaments bonded together with the sizing agent exemplified above is woven into a fabric by a conventional method. Conditions for the radiation of ultrasonic wave to the thus-woven fabric are as described above.

By radiating ultrasonic wave to the fabric immersed in water, the emulsion type sizing agent adhered to the yarn is removed into water. The percent removal of the sizing agent reaches equilibrium in a certain time in proportion to the radiation time of ultrasonic wave. In the actual operation, the radiation time is determined according to the kind of the sizing agent used, the proportion of the emulsifier used, etc. It is also preferable that a water-soluble organic solvent (e.g. alcohol or ketone) be mixed in water in a proportion not more than 10 vol. %, depending on the kind of the sizing agent used.

The apparatus of the present invention will now be explained in more detail with reference to FIG. 1. The numeral 1 denotes a fabric feeder for feeding a carbon fiber fabric 20*a* to be disintegrated; numeral 2 denotes a disintegrating water vessel; numeral 3 denotes an ultrasonic wave oscillator disposed within the disintegrating water vessel 2; numeral 4 denotes a guide plate constituted by a glass plate; numeral 5 denotes a guide supporting frame which supports the guide plate 4 in opposed relation to the ultrasonic wave oscillator; numeral 6 denotes a water depth adjusting weir plate; numeral 7 denotes a delivery belt; numeral 8 denotes a drying device; and numeral 9 denotes a take-up unit for taking up the fabric after disintegration indicated at 20*c*.

The fabric feeder 1 is provided with a roller device 1*a* for feeding out the carbon fiber fabric 20*a* to be disintegrated and a motor 1*b* with a reduction gear for rotating the roller device 1*a*. In an electric control box 10 is incorporated an electric circuit, which makes control so that the rotating speed of the roller device 1*a* is synchronized with the speed of the delivery belt 7.

The water surface in the disintegrating water vessel 2 is at a level defined by the upper edge of the water depth adjusting weir plate 6, and in order to keep the water in the vessel clean, tap water is supplied from a water supply port 2*a* at all times and is discharged from a drain port 2*b*. The water supply port 2*a* is located away from the fabric feeder 1, namely, on the outlet side of the carbon fiber fabric 20, while the drain port 2*b* is located on the inlet side, so a water flow is created in the direction opposite to the advancing direction of the fabric 20 in the water vessel 2, whereby the water in the area where the ultrasonic wave oscillator 3 is located is kept clean.

A height-adjustable guide roller 2*c* is attached to an upper edge portion of the inlet of the disintegrating water vessel 2. The carbon fiber fabric is weak against bending, so by adjusting the height of the guide roller 2*c* the fabric 20*a* being conveyed from the fabric feeder 1 to the guide plate 4 is prevented from a undergoing a large bending force and the fabric 20*b* is conveyed along the oscillator-side face (underside), indicated at 4*a*, of the guide plate 4.

The fabric 20*a* fed into the water vessel 2 is conducted below the guide plate 4 and conveyed along the underside of the guide plate. The water fabric 20 has a certain width and the degree of radiation of ultrasonic wave differs between the central portion and the side portions of the fabric, thus causing a difference in strength of the disintegrating action, so there is a fear of the yarn being disintegrated non-uniformly. In the illustrated apparatus of the present invention, in order to ensure a uniform disintegrating effect, the ultrasonic wave oscillator 3 is mounted on a rotary shaft 3*c* and the rotary shaft 3*c* is rotated at a rate of two revolutions per minute by means of a motor 3*a* with a reduction gear 3*d* through a belt transmission gear 3*e*.

The oscillation frequency and output of the ultrasonic wave oscillator 3 used in the illustrated apparatus are 28 KHz and 1.2 KW, respectively. Since water acts as a load against the oscillator, the oscillator is allowed to oscillate efficiently to minimize the load. To this end, it is better to determine the mounting water depth of the oscillator 3 so as to cause resonance of water. In the ultrasonic wave oscillator 3 with an oscillation frequency of 28 KHz, its mounting water depth is set at 162 mm as an integer multiple of $\frac{1}{2}$ wave length. The water depth for passing of the fabric 20*b* is set at a depth corresponding to an odd multiple of $\frac{1}{4}$ wave length from the water surface where the acoustic pressure of ultrasonic wave is maximum. In the illustrated apparatus, the guide plate 4 is mounted in a depth position of 13.5 mm. In order that the mounting water depth of the ultrasonic wave oscillator 3 and that of the guide plate 4 can be adjusted, a height adjuster (not shown) using a bolt, etc, is attached to each of the weir plate 6 and the guide supporting frame 5.

The carbon fiber fabric 20 has a coarse weave density (3 pcs./cm or so in both longitudinal and transverse directions) because the yarn width expands upon radiation of ultrasonic wave. Therefore, if the fabric 20*b* is allowed to pass under water or along the water surface without using the guide plate 4 and subjected to the radiation of ultrasonic wave, it will become irregular in shape, not affording a uniformly disintegrated fabric. To avoid this problem the guide plate 4 is provided and the fabric 20*b* is allowed to pass the oscillator side of the guide plate. Upon radiation of ultrasonic wave from the ultrasonic wave oscillator 3 during passing of the fabric, the fabric 20*b* is brought into close contact with the guide plate 4 by virtue of an acoustic pressure acting upwards, so that the ultrasonic wave is radiated uniformly to the fabric 20*b*, thus affording a uniformly disintegrated fabric 20*c*.

If the guide plate 4 is mounted in parallel with the water surface, the air dissolved in water will form air bubbles upon radiation of ultrasonic wave, which air bubbles adhere to the guide plate 4 and also to the fabric 20*b*, resulting in that the fabric assumes a non-uniformly disintegrated state. To avoid this inconvenience, that is, to let the air bubbles formed escape from below the guide plate 4, the guide plate is slightly inclined so that the delivery side of the fabric 20*b* is higher.

In the presence of the guide plate 4, the ultrasonic wave radiated from the ultrasonic wave oscillator 3 is reflected by the guide plate 4 and then directed to the fabric 20*b*. At the same time, the guide plate 4 itself also oscillates to cause oscillation of the fabric 20*b* which is in close contact with the guide plate. If the fabric 20*b* is allowed to pass the oscillator side of the guide plate 4, the uniformity of disintegration and the disintegration efficiency will be improved remarkably by a synergistic effect of the above actions.

Even if the fabric 20*b* is allowed to pass along the side face of the guide plate 4 opposite to the oscillator side, there will be attained a certain effect. But the ultrasonic wave will be attenuated because it passes through the guide plate 4 and the fabric 20 will try to rise under the action of the acoustic pressure so it is necessary to provide rollers 5*a*, 5*a* for suppressing such rising tendency of the fabric. However, when the fabric 20 passes over the guide plate 4, it will undulate vertically, so that the ultrasonic wave radiation effect is apt to become non-uniform and the effect of disintegration is inferior to that obtained when the fabric is allowed to pass along the underside of the guide plate 4.

The material of the guide plate 4 for improving the disintegration efficiency is, for example, glass, plastic or aluminum. A transparent plate is suitable because it is possible to check the state of the fabric 20*b* being disintegrated continuously. Particularly, a glass plate is suitable because of a small attenuation factor of ultrasonic wave.

The disintegrated fabric 20*c* which has passed the underside of the guide plate 4 is pulled up from the water vessel 2 by the delivery belt 7. The fabric 20*a* to be disintegrated before the radiation of ultrasonic wave is coarest in weave density, taking into account the expansion of the yarn width when disintegrated, so there will occur a shift in weave if the delivery belt 7 and the fabric feeder 1 are not equal in speed. To prevent such shift in weave, the speed of the delivery belt 7 and that of the fabric feeder 1 are synchronized by the electric circuit incorporated in the electric control box 10. It is a driving motor 7*a* for the delivery belt 7 that keeps constant the speed of the fabric 20*b* which passes the radiation area of ultrasonic wave. The fabric feeder 1 and the take-up unit 9 are controlled in interlock with the speed of the delivery belt 7 to prevent tension from being exerted on the fabric 20 which tension would cause a shift in weave.

The disintegrated fabric 20*c* after the ultrasonic treatment contains a large amount of water, so if it is directly subjected to drying, it will take a considerable time. In view of this point the illustrated apparatus employs as the delivery belt 7 a mesh belt manufactured by Aramid to drain off as large an amount of water as possible before the disintegrated fabric 20*c* enters the drying device 8. Like the adjustable roller 2*c*, the delivery belt 7 is also adjustable its height on the front end side (the guide plate 4 side) to mitigate the bending of the fabric 20*c* at the edge portion of the guide plate 4.

Then, the disintegrated fabric 20*c* is fed to the drying device 8, in which it is dried by hot air of far infrared ray at a temperature not higher than the boiling temperature of water. The drying device 8 is provided with guide belts 8*a*, which are also mesh belts to permit drying of the disintegrated fabric 20*c* from above and below.

The fabric 20*c* thus dried is wound onto a roller 9*a* of the take-up unit 9.

According to the apparatus of the present invention described above, the multifilament yarn of the carbon fiber fabric can be disintegrated into the constituent filaments and there can be obtained a uniformly disintegrated fabric; besides, the working efficiency is high, the apparatus structure is simple, and the operation, maintenance and control are easy.

EXAMPLE 1

A commercially available multifilament carbon yarn (3,000 filaments, TEX 198 g/km) was treated with a sizing agent (1) shown in Table 1 below. Therefore, it was woven into a plain weave having a weight of 200 g/m$^2$ by means of a Rapier loom.

TABLE 1

| | Sizing Agent (1) | Sizing Agent (2) |
|---|---|---|
| Resin | Bisphenol A type epoxy resin | Bisphenol A type epoxy resin |
| Emulsifier | Polyethylene glycol | Polypropylene glycol |
| Emulsifier content in sizing agent | 80% | 27% |

To the fabric thus obtained was radiated ultrasonic wave at the frequency of 28 KHz for a certain time using the apparatus shown in FIG. 1. Through this sizing agent removing step the sizing agent contained in the fabric was removed 100%.

EXAMPLE 2

The same treatment as that described in Example 1 was performed using a sizing agent (2) shown in Table 1. As a result of radiation of ultrasonic wave for a certain time the sizing agent contained in the fabric was removed 50%.

COMPARATIVE EXAMPLE

A fabric obtained using the same sizing agent as that shown in Example 2 was merely passed through the water vessel 2 and not subjected to the radiation of ultrasonic wave. As a result, the percent removal of the sizing agent was 30%.

Upon comparison between the above Example 2 and Comparative Example it is apparent that without radiation of ultrasonic wave only a small portion of the sizing agent is removed, while by the radiation of ultrasonic wave there is removed a larger amount of the sizing agent.

According to the method of the present invention, an emulsion type sizing agent can be removed from a reinforcing yarn fabric easily and effectively. Thus, by applying the method of the present invention to a fabric which has been obtained by bonding a multifilament yarn using a sizing agent followed by weaving, it is possible to remove the sizing agent from the reinforcing yarn fabric easily and effectively without the fear of damage to the fabric during the sizing agent removing step. Thus, according to the present invention it is possible to obtain reinforcing yarn fabrics capable to being impregnated with various matrix materials easily and sufficiently.

What is claimed is:

1. An apparatus for disintegrating a carbon fiber fabric, comprising a water vessel (2), an ultrasonic wave oscillator (3) mounted in an immersed state in said water vessel, a guide plate (4) extending into said water from above the level thereof and positioned parallel to the longitudinal axis of and above said wave oscillator, and a conveyor means (7) for conveying the carbon fiber fabric (20) continuously along an oscillator-side face (4*a*) of said guide plate, said carbon fiber fabric being brought into pressure contact with said face of the guide plate by acoustic pressure induced through said ultrasonic wave oscillators so as to expand said fabric and disintegrate the latter.

2. An apparatus as set forth in claim 1, wherein the ultrasonic wave oscillator (3) is mounted rotatably about an axis perpendicular to the oscillator-side face (4*a*) of the guide plate (4), and means (3*a*) for rotating said oscillator about said axis is provided.

3. An apparatus as set forth in claim 1 or claim 2, wherein the oscillator-side face (4*a*) of the guide plate (4) is inclined with respect to the water surface in the water vessel (2).

4. An apparatus set forth in claim 1 or 2, wherein the oscillator-side face (4*a*) of the guide plate (4) is formed as a curved face which is convex on the oscillator side.

* * * * *